United States Patent [19]

Lewis et al.

[11] 4,256,600

[45] Mar. 17, 1981

[54] TRANSLUCENT SOAP BAR CONTAINING CITRONELLYL ESTERS AS LIME SOAP DISPERSANTS

[75] Inventors: Ronald G. Lewis, Phoenix; Joseph M. Pavelek, Scottsdale, both of Ariz.

[73] Assignee: The Greyhound Corp., Phoenix, Ariz.

[21] Appl. No.: 885,725

[22] Filed: Mar. 13, 1978

[51] Int. Cl.[3] ..... C11D 9/26; C11D 17/00

[52] U.S. Cl. ..... 252/132; 252/108; 252/122; 252/134

[58] Field of Search ..... 252/107, 108, 117, 118, 252/122, 132, 134, DIG. 16; 424/65

[56] References Cited

U.S. PATENT DOCUMENTS

| | | | |
|---|---|---|---|
| 2,404,004 | 7/1946 | Soday | 252/132 |
| 2,889,254 | 6/1959 | Fiore et al. | 252/108 X |
| 3,155,624 | 11/1964 | Kelly | 252/122 |
| 3,317,397 | 5/1967 | Saunders | 252/132 X |
| 3,493,650 | 2/1970 | Dankel | 424/65 |
| 3,562,167 | 2/1971 | Kamen et al. | 252/121 |
| 3,793,214 | 2/1974 | O'Neill et al. | 252/117 |
| 3,864,272 | 2/1975 | Toma et al. | 252/125 |
| 3,903,008 | 9/1975 | Deweever et al. | 252/118 |
| 3,969,259 | 7/1976 | Lages | 252/107 |

FOREIGN PATENT DOCUMENTS

| | | |
|---|---|---|
| 49-28645 | 7/1974 | Japan . |
| 50-37803 | 4/1975 | Japan . |
| 23117 | of 1911 | United Kingdom . |

*Primary Examiner*—P. E. Willis, Jr.

*Attorney, Agent, or Firm*—Frank T. Barber; Charles E. Cates; Richard G. Harrer

[57] ABSTRACT

A translucent deodorant non-germicidal soap bar incorporates selected citronellyl esters, and a suitable alcohol, especially those selected from polyalkylene glycols and/or liquid polyols, to make a soap composition that has superior lime soap dispersancy without loss of translucency, and, in at least one case, is both deodorant and non-germicidal. The polyols have a molecular weight between about 62 to about 342 and the polyalkylene glycols have a molecular weight between about 200 to about 4,000. An effective amount of citronellyl senecioate is added, preferably about 1% by weight. The preferred concentrations of the polyalkylene glycols and polyols range between about 0.5% to 5% by weight.

9 Claims, No Drawings

TRANSLUCENT SOAP BAR CONTAINING CITRONELLYL ESTERS AS LIME SOAP DISPERSANTS

BACKGROUND OF THE INVENTION

1. Field of the Invention

This invention relates to the art of making translucent soap bars and more particularly to improving the lime soap dispersancy of such bars, and adding a deodorant non-germicidal ingredient thereto without impairing the translucency.

2. The Prior Art

Soap making is an ancient art whose basic precepts are still employed in present day manufacturing plants. One of the ancient specialties of soap making is the art of compounding translucent and transparent bars which, for the purposes of this disclosure, may be lumped under the single category "translucent bars." Because of their attractive appearance, translucent bars command a limited but significant share of the market. The optimum qualities of a translucent bar soap in the prior art are taught in U.S. Pat. No. 3,864,272.

But for the influence of certain problems hereafter discussed, translucent bars might have a significantly larger and more important share of the market. Among the problems of the prior art is the difficulty in making a translucent bar which performs well in hard water, and especially one that is deodorant and non-germicidal.

In many parts of this country and other parts of the world, the water is "hard" by reason of the presence of bivalent ions such as, for example, magnesium and calcium, which combine with the fatty acids of soap to form an insoluble product known as "lime soap." A soap that performs well in hard water must have the ability to disperse and hold in solution this lime soap, which property will sometimes hereafter be referred to as lime soap dispersancy.

The prior art workers succeeded in making a translucent soap bar which is deodorant and/or germicidal or a translucent bar which performs reasonably well in hard water, but they have not been able to make a deodorant, non-germicidal, translucent bar that performs well in hard water.

Thus, in hard water areas, users have to forego either translucency or deodorancy because lime soap dispersancy in such areas is absolutely essential. Moreover, a need exists for an ordinary translucent bar with improved lime soap dispersancy.

These problems represent an existing need felt by the user and the soap industry, and they have been met by means of the instant invention.

3. Brief Summary of the Invention

It has been discovered that the combination of a soap base, a citronellyl ester (such as, for example, citronellyl senecioate, citronellyl formate, citronellyl acetate and citronellyl isobuterate) and a suitable alcohol, especially one or more polyalkylene glycols having a molecular weight between about 200 and about 4,000, preferably those selected from the group consisting of polyethylene glycol having a molecular weight from about 600 to about 1500, and/or one or more polyhydric alcohols having a molecular weight between about 62 and about 342, preferably those selected from the group consisting of diols and triols having a molecular weight from about 76 to about 134, is a significantly better translucent soap having improved lime soap dispersancy; and in at least one instance (citronellyl senecioate) it adds deodorant activity to the soap bar without destroying its translucent character.

A concentration of a citronellyl ester of at least about 1.0 weight percent is required for noticeably effective results—the upper limit being dictated by economics—for a translucent bar that exhibits deodorancy. Inasmuch as citronellyl senecioate has a demonstrated deodorancy (see U.S. Pat. No. 3,493,650 to Universal Oil Products), it may be inferred that the other citronellyl esters also have deodorancy.

A range of concentration from about 0.5% to 5% of polyalkylene glycol and/or polyhydric alcohol is ideal for satisfactory results. Examples of polyols useful in this invention are, among others, butanediol, hexylene glycol, 1,5-pentanediol, cyclohexanediol, and sugars such as sucrose and sorbitol. Examples of polyalkylene glycols are polyoxypropylene glycol and polyoxybutylene glycol. As much as 30% by weight of a soap bar could be added, but much lower concentrations are preferred.

A soap suitable for the translucent bar of this invention is a long chain fatty acid neutralized by a suitable alkali metal hydroxide, preferably sodium and/or potassium hydroxide. It is also preferable to use a slight excess of the alkali metal hydroxide in the neutralization step to improve soap stability. The fatty acids employed may be obtained from any typical fatty acid source that is consistent with the state of the art. The soap composition may also contain additional additives consistent with the state of the art such as silica and clarifying agents, emollients, perfumes, color, etc.

Subject to the above remarks, a preferred translucent soap is one made according to the teachings of U.S. Pat. No. 3,864,272 to Toma, et al, in combination with a citronellyl ester, e.g., citronellyl formate, citronellyl acetate, citronellyl isobuterate, and citronellyl senecioate. As taught in the said patent, in some combinations containing only one of the glycols or polyols, the addition of glycerine, suitably from about 1–3 percent based on the weight of the soap is necessary.

PREFERRED EMBODIMENTS OF THE INVENTION

The presently preferred embodiment of the invention comprises a translucent soap containing an 80/20 ratio of Tallow/Coco which contains a 94/6 Na/K ratio, 1½% polyethylene glycol having a molecular weight of about one thousand (this can be obtained commercially under the trade name Carbowax from the Union Carbide Corp.), 1½% propylene glycol having a molecular weight of 76, 1% citronellyl seneciotate (this can be obtained commercially from Naarden-UOP Fragrances, Inc. under the trademark "Sinodor"), and a water content relating to 18% (±2%) soap pellet moisture. Compatible color and perfume are added q.s. to this soap composition.

The inclusion of both a polyalkylene glycol and a polyol is preferred, although satisfactory results can be obtained with the inclusion of only one of the two. A suitable combination would be the soap base above-described with 3% polyethylene glycol having a molecular weight of 1,000 and 1% citronellyl senecioate, to which may be added compatible perfumes and color, q.s. Similarly, propylene glycol may be substituted for the polyethylene glycol, thus yielding a satisfactory but less preferred product.

Other liquid polyols having molecular weights between 62 and 342 may also be substituted for the preferred propylene glycol ingredient with satisfactory results. Examples of such polyol substitutes are glycerine, hexylene glycol, cyclohexanediol and sorbitol. The consideration involved in selecting polyols is that they be selected from those that do not destroy the translucent property of the bar. The polyol selection from the molecular weight range indicated satisfies this requirement.

Polyalkylene glycols having molecular weights between 200 and 4,000 may also be substituted for the preferred ethylene glycol-1000 with satisfactory results. Examples of such polyalkylene glycols are polyoxypropylene glycol and polyoxbutylene glycol. The important consideration involved in selecting a polyalkylene glycol are that it be completely miscible with the citronellyl compound and that it not destroy the translucent property of the product.

To the soap product of this invention may be added perfumes and colors q.s. Not all perfumes and not all colors will work in a translucent soap bar; however, the usable colors and perfumes are well-known to persons working in the art, and a suitable selection can be made without undue experimentation. An example of a soap bar with color and perfume is shown in Example III hereafter.

EXAMPLE I

A study of lime soap dispersancy was conducted on translucent soap containing 0.4%, 1% and simulated 5 and 10% citronellyl senecioate in combination with polyethylene glycol having a molecular weight of about one thousand and propylene glycol according to the following protocol:

Ten percent soap solutions containing an 80/20 ratio of Tallow/coco and 94/6 ratio of Na/K, and 0.4%, 1%, 5% and 10% citronellyl senecioate, were prepared by dissolving the soap in deionized water. Finished soap bars were used to make the 0.4% and 1% citronellyl senecioate soap solutions. Because of the unavailability of finished bars, the 5% and 10% citronellyl senecioate solutions were simulated by making the soap solutions with placebo and adding the citronellyl senecioate directly to the solutions.

To 100 gram samples of hard water containing 200, 300, 350, 400, 500 and 600 ppm of calcium carbonate respectively were added 1 ml. aliquots of the 10% solutions. The resulting series of 0.1% soap solutions in hard water were graded for visible dispersed lime soap and flocculated lime soap on the following scale.

Curd Appearance

D=Dispersed lime soap only.
DF=Dispersed lime soap with trace amount of flocculent precipitate.
MF=Moderate amount of flocculent precipitate.
F=Large amount of flocculent precipitate.

Solution Appearance

0=No visible dispersed lime soap.
1=Trace amount of visible dispersed lime soap—light haze
2=Moderate amount of visible dispersed lime soap—transparent.
3=Large amount of visible dispersed lime soap—thinly opaque.
4=Very large amount of visible dispersed lime soap—milky opaque.

The results, which showed that 1% Sinodor perceptibly improved lime soap dispersancy effect in this particular soap base, were recorded and reproduced below in Table I.

TABLE I

Lime Soap Dispersancy of Translucent Soaps Containing 0–10% Citronellyl Senecioate

| % Citronellyl Senecioate in Bar | Water Hardness (ppm-$CaCO_3$) 200 | 300 | 350 | 400 | 500 | 600 |
|---|---|---|---|---|---|---|
| 0-Placebo | D3 | D4 | MF3 | F2 | F1 | F1 |
| 0.4 | D3 | D4 | DF3 | F2 | F1 | F1 |
| 1 | D3 | D4 | D4 | F2 | F1 | F1 |
| 5 | D1 | D2 | — | DF4 | F2 | F1.5 |
| 10 | D1 | D2 | — | D4 | DF4 | MF4 |

Water Hardness at Which Flocculent Precipitate First Appears for Translucent Soaps Containing 0–10% Citronellyl Senecioate

| % Citronellyl Senecioate in Bar | Water Hardness (ppm-$CaCO_3$) |
|---|---|
| 0-Placebo | 300–350 |
| 0.4 | 350 |
| 1 | 350–400 |
| 5 | 400 |
| 10 | 500 |

LIME SOAP SOLUBILITY AND DISPERSANT TEST

A test method was developed for the purpose of determining the ability of additive candidates to dissolve and/or suspend lime soaps (calcium stearate, calcium palmitate, and magnesium stearate) when added to solutions of the additive with/without the presence of soap. This test method calls for addition of 0.02 g of each lime soap, individually or in combination, to 100 ml. of the additive test solution followed by a one-hour heating period of 50° C. The test samples are then left at ambient temperatures for about 16 hours before final evaluation. Each sample is then evaluated according to opacity (o, finely divided suspended solids) and solids content (s, undissolved larger particles). A similar set of test samples containing only the appropriate lime soap(s) and deionized water was employed as the standard for this evaluation. Two scales were used for the evaluation: opacity (0 to −5) with 0=clear and −532 very heavy opacity, and solids (0 to +5) with 0=same amount as standard and +5=no large particulate matter. All solutions were made with deionized water. The soap used was the 85/15 (T/C) and 94/6 ratio of Na/K.

The set of scores for each additive was then compared to those found for soap ($3.4\times10^{-4}$ M). The values were tabulated and recorded in Table II below. In the convention adopted the more positive value in each column of the Table indicates the better performance. Thereafter, the column differences (± depending on the performance relative to soap) were then totaled to give a composite dispersing score.

TABLE II

| | Ca Palmitate o | Ca Palmitate s | Ca Stearate o | Ca Stearate s | Mg Stearate o | Mg Stearate s | All Three o | All Three s |
|---|---|---|---|---|---|---|---|---|
| Soap = | −1 | +3 | −4 | +3 | −4 | +1 | −5 | +2 |
| Citronellyl Senecioate + Soap = | −1 | +3 | −3½ | +2 | −3 | +2 | −5 | +2½ |
| Difference = | 0 | 0 | +½ | −1 | +1 | +1 | 0 | +½ |
| Difference | | | | | | | | |

TABLE II-continued

| | Ca Palmitate | | Ca Stearate | | Mg Stearate | | All Three | |
|---|---|---|---|---|---|---|---|---|
| | o | s | o | s | o | s | o | s |
| Total = +2 | | | | | | | | |

EXAMPLE II

Using the protocol of Example I, various combinations of soap, citronellyl senecioate, polyethylene glycol and propylene glycol were tested for lime soap dispersancy, using a base score of zero for soap only having an 85/15 Tallow/coco ratio. The full combination was made according to the following formula: Soap $3.4\times10^{-4}$ M; $5\times10^{-4}$ M polyethylene glycol 1000; $66\times10^{31\ 4}$ M propylene glycol, and $3.4\times10^{-4}$ M citronellyl senecioate. Various combinations of ingredients were obtained by deleting one or more ingredients. The results are shown in Table III below.

TABLE III

| Active | Score |
|---|---|
| Soap | 0 |
| Soap + Citronellyl Senecioate | +2 |
| Soap + Polyethylene Glycol 1000 (PEG) | +3.5 |
| Soap + Propylene Glycol (P.G.) | +3.5 |
| Soap + P.G. + Citronellyl Senecioate | +5 |
| Soap + PEG + Citronellyl Senecioate | +8.5 |

The concentration of citronellyl senecioate may be from about 1% to about 10% by weight. The limiting factor on the upper range of the concentration is principally economic inasmuch as the testing done with various concentrations of citronellyl senecioate makes it appear that the lime soap dispersancy effect is proportional to the amount of citronellyl present. The amount included should be enough to be effective which may vary according to the formulation.

The ratio of citronellyl senecioate to polyol and/or polyalkylene glycol is not critical; however, the preferred ratio is about 20:1 to 1:5.

EXAMPLE III

A translucent soap bar was made according to the following formula: Soap 80/20 (T/C) with 94/6 (Na/K) ratio, 77.56%; polyethylene glycol 1000, 1½%; propylene glycol, 1½%; lemon perfume 0.4%; color 0.04%; water (18% pellet moisture); citronellyl senecioate 1%.

The mechanism of the invention seems to proceed in two ways: one by delayed flock reaction and a second by increased dispersion of lime soap. Because the two mechanisms seem to play a presently uncharted role in the reactions, the optimum mix of polyalkylene glycols may vary depending on the concentrations and identities of the citronellyls and polyols. However, with the teachings of this disclosure as a reference, a person ordinarily skilled in the art can practice the invention without need for undue experimentation. The examples that follow will help in this respect.

EXAMPLE IV

Four compounds: citronellyl senecioate, citronellyl acetate, citronellyl formate, and citronellyl isobuterate were tested according to the protocol described in Example I above. The results indicated that citronellyl formate and citronellyl isobuterate are as effective with respect to lime soap dispersion as citronellyl senecioate in combination with carbowax 1000 and propylene glycol. Citronellyl acetate also shows significant lime soap dispersal activity.

The test results are shown in Table IV below.

TABLE IV

Lime Soap Dispersion Action of Citronellyl Esters

| Active | 10% Active* 2 Min. | 10% Active* 1 Hr. |
|---|---|---|
| Carbowax 1000 + Propylene Glycol**(C-P) | 0/075*** | 0/0 |
| C-P plus Sinodor**** | 170/>150 | 125/100 |
| C-P plus Citronellyl Acetate | 100/>200 | 0/100 |
| C-P plus Citronellyl Formate | >300/>200 | 100/>300 |
| C-P plus Citronellyl i-Buterate | 100/>200 | 100/>300 |

*This % value represents the amount of lime soap dispersant relative to the amount of soap plus Carbowax 1000 + Propylene Glycol.

**This value is an average of four test evaluations. The test concentrations were: Carbowax 1000 = 0.0015%, propylene glycol = 0.0015%, and soap = 0.097%.

***The values shown are: (ppm $CaCO_3$ at which fine flock appears for test soap) minus (ppm $CaCO_3$ at which fine flock appears for placebo soap) / (ppm $CaCO_3$ at which heavy flock appears for test soap) minus (ppm $CaCO_3$ at which heavy flock appears for placebo soap). Thus, the higher scores indicate better lime soap dispersancy performances.

****This result is an average of four test evaluations.

EXAMPLE V

Following the protocol described in Example I above, a number of tests of samples not containing a citronellyl were made to determine the lime soap dispersancy values of the combinations. The results are arranged below in order of decreasing efficacy.

TABLE V

Two Minute Evaluations 1.5% PrG
3% PEG+3% PrG
3% PrG=3% PEG
1.5% PEG+1.5% PrG=soap only
1% PEG+1% PrG=5% PEG+5% PrG=5% PEG=2% PEG+3% PrG=3% PEG+2% PrG
5% PrG All of the remaining combinations were equal to the 1.5% PEG plus 1.5% PrG combination. The main differences were in the amount of flock formation.

TABLE IV

One Hour Evaluations 1.5% PrG=3% PEG=1% PEG+1% PrG=5% PEG+5% PrG=3% PEG+2% PrG
1.5% PEG+1.5% PrG=soap only
3% PEG+3% PrG The differences in these evaluations were slight, and were mainly exhibited in the dispersion power at water hardness equal to 300 ppm $CaCO_3$. All of the remaining combinations were equal to the 1.5% PEG plus 1.5% PrG combination.

EXAMPLE VI

Following the protocol of Example I above, combinations of propylene glycol and Carbowax (polyethylene glycol, molecular weight 1000) were tested in the presence of a soap solution containing ten percent citronellyl senecioate (soap plus polyalkylene glycol and citronellyl senecioate equalling 100%). The addition of the citronellyl senecioate improved the lime soap dispersancy performance in every example tested, resulting in an improvement in decreased and delayed flock formation characteristics of water hardnesses, especially those below 400 parts per million $CaCO_3$. The results at two minute evaluations were better than corresponding results obtained from one hour evaluations. The results are listed below in Tables VII and VIII in order of decreasing efficacy.

TABLE VII

Two Minute Evaluations 1.5% PrG
3.0% PrG=3% PEG=3% PrG=0.5% PEG=0.5% PrG
1.5% PEG+1.5% PrG=3% PEG=3% PEG −2% Prg

TABLE VIII

One Hour Evaluations 0.5% PEG
3% PEG
3% PrG
1.5% PEG+1.5% PrG
2% PEG+3% PrG
3% PEG+2% PrG=5% PrG=5% PEG+5% PrG
0.1% PEG+0.1% PrG
5% PEG

What is claimed is:

1. A translucent soap bar composition comprising a fatty acid soap; about 0.5% to 30% of at least one alcohol selected from the group consisting of polyalkylene glycols having molecular weights from about 200 to about 4,000 and polyols having molecular weights from about 62 to about 342, and mixtures thereof; and an amount of a citronellyl ester effective to make the composition deodorant and lime soap dispersant without destroying the translucency of the bar.

2. The composition of claim 1 wherein said citronellyl ester is selected from the group consisting of citronellyl formate, citronellyl acetate, citronellyl isobuterate and citronellyl senecioate.

3. The composition of claim 2 in bar form wherein the polyalkylene glycol is selected from the group consisting of polyethylene glycol, polybutylene glycol, and polypropylene glycol, and the polyol is selected from propylene glycol, hexylene glycol, glycerine, cyclohexanediol and sorbitol.

4. The composition of claim 1 wherein the polyalkylene glycol is polyethylene glycol having a molecular weight of about 1,000.

5. The composition of claim 1 wherein the polyol is propylene glycol.

6. The composition of claim 2 wherein the citronellyl comprises about 1.0 to 10%, the polyol comprises about 0.5 to 5%, and the polyalkylene glycol comprises about 0.5 to 5%, of the composition by weight.

7. The composition of claim 1 in bar form wherein the soap, the citronellyl ester, the polyol, the polyalkylene glycol and water comprise by weight about 78 parts, 1 part, 1½ part, 1½ part and about 18 parts respectively, with color and perfume q.s.

8. A translucent, non-germicidal, deodorant soap composition comprising a fatty acid soap base, effective amounts of a citronellyl senecioate, about 0.5% to 30% one or more alcohols selected from the group consisting of polyols having a molecular weight about 62 to 342 and polyalkylene glycols having molecular weights from about 200 to 4,000, and mixtures thereof.

9. The composition of claim 8 in bar form wherein the alcohols are polyethylene glycol and propylene glycol.

* * * * *